US009901965B2

(12) United States Patent
Yamamoto

(10) Patent No.: US 9,901,965 B2
(45) Date of Patent: Feb. 27, 2018

(54) DOUBLE ACTION EXTRUSION PRESS

(71) Applicant: Ube Machinery Corporation Ltd., Ube (JP)

(72) Inventor: Takeharu Yamamoto, Ube (JP)

(73) Assignee: Ube Machinery Corporation, Ltd. (JP)

( * ) Notice: Subject to any disclaimer, the term of this patent is extended or adjusted under 35 U.S.C. 154(b) by 215 days.

(21) Appl. No.: 14/436,289

(22) PCT Filed: Feb. 3, 2014

(86) PCT No.: PCT/JP2014/052433
§ 371 (c)(1),
(2) Date: Apr. 16, 2015

(87) PCT Pub. No.: WO2014/188741
PCT Pub. Date: Nov. 27, 2014

(65) Prior Publication Data

US 2015/0283593 A1 Oct. 8, 2015

(30) Foreign Application Priority Data

May 24, 2013 (JP) ..... 2013-109786

(51) Int. Cl.
*B21C 23/21* (2006.01)
*B21C 25/04* (2006.01)
*B21C 31/00* (2006.01)

(52) U.S. Cl.
CPC ..... *B21C 23/211* (2013.01); *B21C 23/21* (2013.01); *B21C 23/217* (2013.01); *B21C 25/04* (2013.01); *B21C 31/00* (2013.01)

(58) Field of Classification Search
CPC ... B21C 23/217; B21C 23/218; B21C 23/085; B12C 23/21; B12C 23/211; B12C 23/212; B12C 23/215; B12C 31/00
(Continued)

(56) References Cited

U.S. PATENT DOCUMENTS 3,362,208 A * 1/1968 Murphy ..... B21C 23/21 72/260
3,709,013 A 1/1973 Petsch
(Continued)

FOREIGN PATENT DOCUMENTS

FR 1069436 7/1954
JP 49-26188 B 7/1974
(Continued)

*Primary Examiner* — R. K. Arundale
*Assistant Examiner* — Mohammad Yusuf
(74) *Attorney, Agent, or Firm* — DLA Piper LLP (US)

(57) ABSTRACT

A double action extrusion press has: a main crosshead provided freely movable with the application of pressure in an axial direction by a main cylinder and having a pressing system disposed on the tip thereof; and a piercer cylinder built into the main cylinder and provided within the main ram, allowing a mandrel to slide within the pressing system and the main crosshead. The double action extrusion press complements the extrusion force by force equivalent to a mandrel pull force acting on a mandrel stop rod by affixing the piercer cylinder in contact to a piercer crosshead that is joined with the mandrel stop rod and applying hydraulic force to the rod side of the piercer cylinder.

5 Claims, 2 Drawing Sheets

(58) Field of Classification Search
USPC ..... 72/265, 453.02, 453.06, 453.08
See application file for complete search history.

(56) References Cited

U.S. PATENT DOCUMENTS

| | | | | | |
|---|---|---|---|---|---|
| 3,868,841 | A * | 3/1975 | Couchman | B21C 23/217 | 72/260 |
| 4,050,281 | A * | 9/1977 | Sibler | B21C 23/217 | 72/265 |
| 4,206,626 | A * | 6/1980 | Groos | B21C 23/217 | 72/253.1 |
| 4,523,444 | A * | 6/1985 | Fuchs, Jr. | B21C 25/00 | 72/21.1 |
| 2008/0245125 | A1 | 10/2008 | Hagen et al. | | |

FOREIGN PATENT DOCUMENTS

| | | |
|---|---|---|
| JP | 61-147916 | 7/1986 |
| JP | 61-205606 U | 12/1986 |
| JP | 2007-517669 | 7/2007 |

* cited by examiner

DOUBLE ACTION EXTRUSION PRESS

TECHNICAL FIELD

The present invention relates to a double action extrusion press which applies hydraulic pressure to a rod side of a piercer cylinder which is attached inside a main ram to thereby supplement an extrusion force to counter a mandrel pull force which acts on a mandrel stop rod.

BACKGROUND ART

In the past, for example, in a known configuration, an extrusion press which uses copper, aluminum, or their alloys etc. to extrude tubular shaped products by double action extrusion comprises a cylinder platen and end platen which are arranged facing each other. The cylinder platen is provided with a main cylinder, main ram, pressure stem, and mandrel. The end platen is provided with a die. A container is provided between the pressure stem and the die so as to be able to advance and retract by a container cylinder.

The pressure stem, which has a dummy block arranged at its front end, has been attached through a main cross head to a main ram which is assembled in the main cylinder which is provided at the cylinder platen. At a center position of the pressure stem, a mandrel is arranged to be able to advance and retract accompanying the pressure stem together with the piercer cylinder rod. Further, the die has been attached to the end platen facing the pressure stem.

Between the pressure stem and the die, the container has been arranged to be able to advance and retract. In the container, a billet has been held. The pressure stem moves the billet which is held in the container to the die side whereby the billet is pushed and upset is completed. After upset, the mandrel advances and the billet is pierced. The mandrel stops at a predetermined advancing position in the die and the pressure stem again advances, whereby the billet is extruded as a tubular shaped product by double action extrusion.

In a double action of extrusion press, the front end part of the mandrel is made to stop at a predetermined position of the bearing part of the die to extrude the product. At that time, even if the relative positions of the mandrel and the bearing part of the die are pulled by the product, the mandrel position is held so that the stop position does not shift.

PLT 1 discloses a double action type of extrusion press where a piercer cylinder which is provided inside the main cylinder and a stop fastener which detaches from the axial center of the extrusion press to forcibly couple with the mandrel are provided. The stop fastener acts on a hydraulic pilot valve to start the supply of a certain amount of the pressurized oil medium to the rod side chamber of the piercer cylinder so as to hold a predetermined axial direction position (stop position) of the bearing part of the die. The supply of the pressurized oil medium is made to match the increase in volume of the piercer cylinder rod side chamber when the mandrel stops and the main ram advances during control to hold the position.

In this regard, the conventional type of double action extrusion press is designed to mechanically switch the hydraulic pilot valve through the stop fastener and connecting rod to supply a certain amount of pressurized oil medium to thereby hold the mandrel at a predetermined position of the bearing part of the die, so a delay occurs in control of exactly the stroke of movement corresponding to the land of the spool of the hydraulic pilot valve, and the front end part of the mandrel moves back and forth by several millimeters with respect to a predetermined stop position during extrusion.

For this reason, variation occurred in the thickness of the extruder tubular shaped product and a stable quality of tubular shaped product could not be obtained.

Furthermore, in a conventional double action extrusion press, there is the following problem:

When pushing a billet into the container by the pressure stem, then upsetting the billet and piercing the inside of the billet by the mandrel, then extruding the billet by a fixed mandrel, frictional force occurs between the billet and the mandrel surface and a pull force acts on the mandrel during extrusion. Due to this, the extrusion force which acts on the die decreases by that amount and the extrusion force could not be effectively utilized at the start of extrusion when the required extrusion force is most necessary.

CITATIONS LIST

Patent Literature

PLT 1: Japanese Patent Publication No. 49-26188B2

SUMMARY OF INVENTION

Technical Problem

The present invention is made in consideration of the above conventional problem and has as its object the provision of a double action extrusion press which supplements the extrusion force which falls due to the mandrel pull force which acts during extrusion due to the frictional force which occurs between the billet and mandrel surface by using a piercer cylinder which is fastened to a piercer cross head.

Solution to Problem

The double action extrusion press according to a first aspect of the present invention is a double action extrusion press comprising a main cross head adapted to be able to be pushed in an axial direction by a main cylinder and having a pressure stem at its front end, and a piercer cylinder adapted to slide a mandrel in the pressure stem and the main cross head and being provided in a main ram which is built into the main cylinder, wherein the piercer cylinder is fixedly connected to a piercer cross head which is connected with mandrel stop rods, and wherein an extrusion force is supplemented by applying hydraulic pressure to a rod side of the piercer cylinder so as to counter the mandrel pull force which acts on the mandrel stop rods.

In the present invention, the double action extrusion press further comprises a means for detecting the mandrel pull force which acts on the mandrel stop rods and controls the hydraulic pressure at the rod side of the piercer cylinder to become a hydraulic pressure of a predetermined force corresponding to the mandrel pull force which is detected by the means to thereby supplement the part of the extrusion force which is lost as the mandrel pull force.

In the double action extrusion press of the present invention, mandrel cylinders which drive a mandrel which is fastened with a piercer cross head may be used to position the front end part of the mandrel at the bearing part of the die which determines the size of the tubular shape by making an advancing limit of the mandrel cylinder the positioning of the mandrel.

In the double action extrusion press of the present invention, the mandrel cylinders may be fastened to the outer circumference of the main cylinder.

In the double action extrusion press system of the present invention, the piercer cross head which is fastened to the mandrel stop rod can move inside the main cross head.

In the double action extrusion press system of the present invention, the piercer cylinder and the mandrel cylinder rods may be fastened to the piercer cross head.

In the double action extrusion press system of the present invention, a variable discharge type hydraulic pump is preferably used to enable adjustment of the amount of oil of the piercer cylinder.

Advantageous Effects of Invention

The mandrel cylinder rods are connected to the piercer cross head which operates to be able to freely slide inside the main cross head. Furthermore, the mandrel cylinders are fastened to the main cross head, so if making hydraulic pressure act on each rod side of the mandrel cylinders, a force acts making the piercer cylinder retract. A counter force acts on the main cross head and the load is propagated to the front end of the pressure stem to extrude the billet.

For this reason, a larger extrusion force than the past acts on the pressure stem during extrusion and therefore a thin tubular shaped product or long billet which could not be extruded in the past can be extruded. Further, even if extruding extruded products of the same tube diameter, it becomes possible to extrude them by a small sized double action extrusion press. For this reason, it is possible to improve the productivity and save energy or save labor.

A means is provided for detecting the mandrel pull force which acts on the mandrel stop rods when the pressure stem pushes the billet to move in the extrusion direction. The hydraulic pressure at the rod side of the piercer cylinder is controlled to a hydraulic pressure of a predetermined force corresponding to the mandrel pull force which is detected by this means so as to make up for the part of the extrusion force which is lost as mandrel pull force, so even if the extrusion force fluctuates during the extrusion operation, there is no need to adjust the pressure or amount of feed of the working oil which is supplied to the piercer cylinder each time and the operability can be improved. Below, the present invention will be able to be better understood from the attached drawings and description of a preferred embodiment of the present invention.

DESCRIPTION OF EMBODIMENTS

Below, a double action extrusion press 10 according to the present invention will be explained with reference to FIG. 1.

Figure 1:
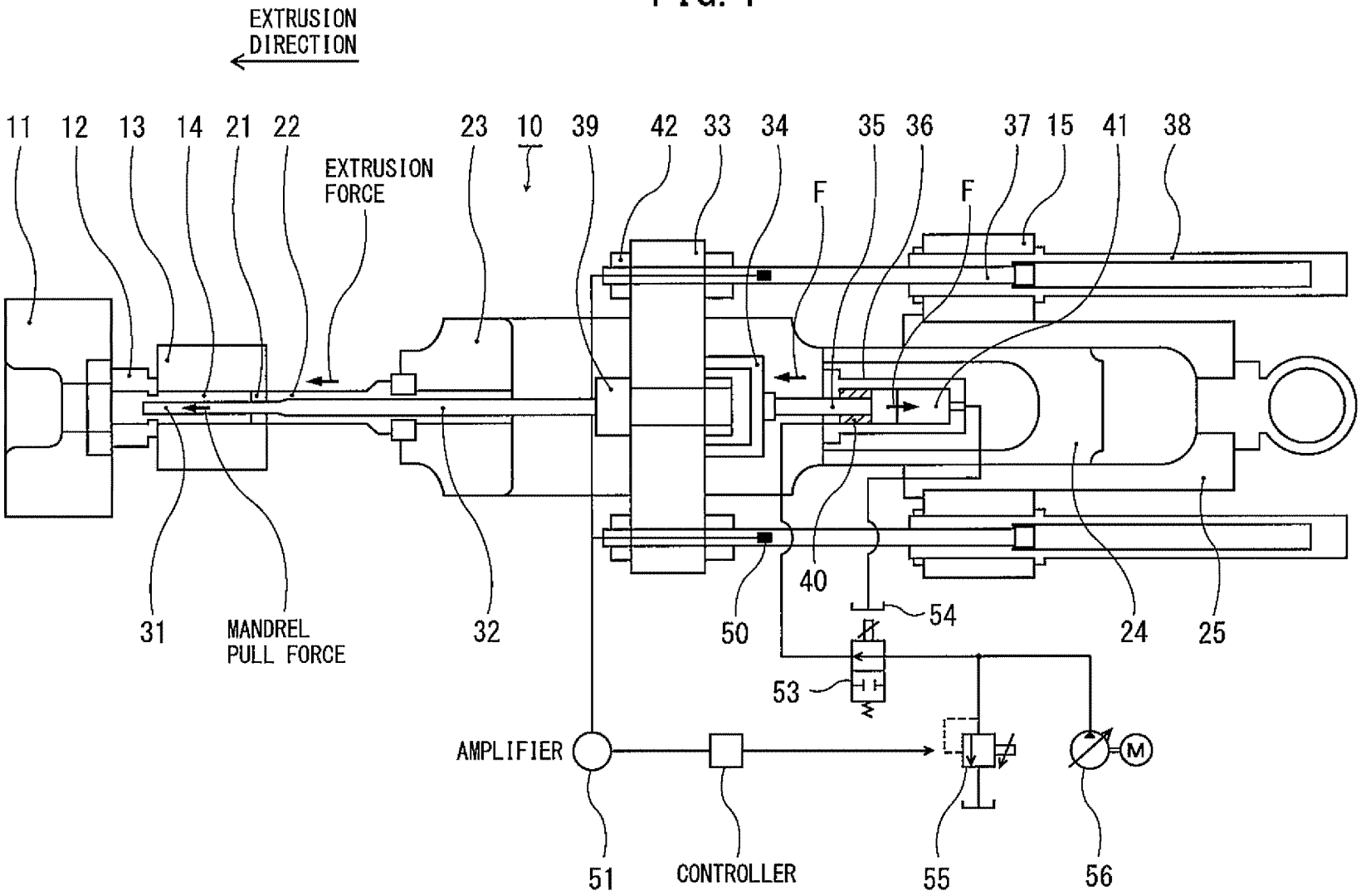
FIG. 1 is a cross-sectional view of an elevation which shows an outline of a double action extrusion press of the present invention.
Figure 2:
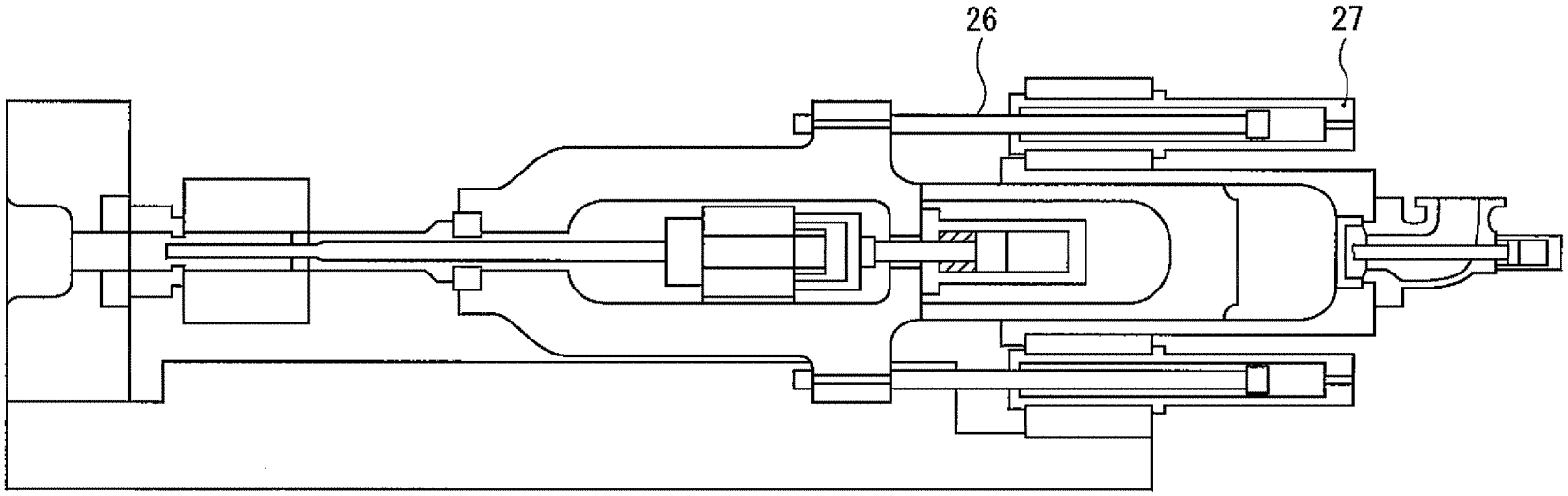
FIG. 2 is a cross-sectional view of a front view which shows an outline of a double action extrusion press of the present invention.

As shown in FIG. 1, the extrusion press 10 comprises an end platen 11 and a cylinder platen 15 arranged facing each other. The end platen 11 is provided with a die 12, while the cylinder platen 15 is provided with a main cylinder 25, main ram 24, main cross head 23, and pressure stem 22. Between the end platen 11 and the cylinder platen 15, there is a container 13 which can advance and retract by a not shown container cylinder which is arranged at the end platen 11.

The pressure stem 22 is attached to the main ram 24 which is assembled in the main cylinder 25 which is provided at the cylinder platen 15 through the main cross head 23. At a center position of the pressure stem 22, a mandrel 31 is attached through a sub mandrel 32 and mandrel holder 39 to a piercer cross head 33 and is arranged to be able to advance and retract freely accompanying the pressure stem. The die 12 is provided at the end platen 11 facing the pressure stem 22.

Further, a billet 14 is supplied between the die 12 and the container 13 which moves to the cylinder platen 15 side together with a dummy block 21 by a not shown billet loader. Alternatively, in order to enable smooth supply of the billet 14, after only the billet 14 is inserted into the container 13 and the pressure stem 22 is retracted, the dummy block 21 may be moved to the center of the extrusion press by a not shown dummy block supply device and inserted into the container 13.

At the main cylinder 25, mandrel cylinders 38 are fastened. At mandrel stop rods 37 of the mandrel cylinders 38, the piercer cross head 33 is attached and is arranged to be able to freely advance and retract inside of the main cross head 23.

Furthermore, at the piercer cross head 33, a piercer cylinder rod 35 is attached via a connecting part 34. Further, a piercer cylinder 36 is attached inside of the main ram 24 by bolting or other fastening to the main cross head 23.

Next, the operation of the double action extrusion press 10 will be explained. A billet which is carried on a not shown billet loader is positioned at the center of the container, then the main ram 24 is made to advance to insert the billet in the container 13 in the state where front end of the pressure stem 22 is made to contact the end face of the dummy block 21. Next, the pressure stem 22 is made to retract once, then pressurized oil is introduced to each head side of the mandrel cylinders 38 and the billet is pierced while making the mandrel 31 advance. The front end of the mandrel 31 is made to stop and be held at a predetermined position of the bearing part of the die 12.

At this time, pressurized oil is applied to the head side so that the mandrel stop rods 37 of the mandrel cylinders 38 become the advancing limit whereby the mandrel 31 is prevented from shifting in position even in the later extrusion process.

Further, the length of the mandrel stopper rod 37 can be freely adjusted by a mandrel stopper device 42. Accordingly, even if the die 12 changes in size and the bearing part changes in position, the front end of the mandrel 31 can be fixed in position.

After the above operation is performed, the pressure stem 22 is made to advance to start the extrusion.

After the extrusion ends, the pressure of the pressurized oil which pushes the main ram 24 to the advancing side is lowered, pressurized oil is made to act on the piercer cylinder 36 and mandrel cylinders 38 at the rod side port to make the mandrel 31 retract, and pressurized oil is supplied to the rod side of the side cylinder 27 and the ram cylinder body 25 to make the main cross head 23 and pressure stem 22 retract. Further, the container is made to separate from the die 12, and a not shown shear device is used to cut off a discard. Then, the dummy block 21 is unloaded from the press by a not shown dummy block recovery device and the press is newly supplied with a not shown dummy block at the press center by a loading device to prepare for the next extrusion operation.

After this, the container 13 is again made to advance to make it abut against the die 12, a billet is supplied to an intermediate position of the container 13 and the pressure stem 22 to insert the billet in the container 13, then the above operation is repeated.

The function of the piercer cylinder 36 which supplements the extrusion force to counter the mandrel pull force in the above such double action extrusion press will be explained with reference to FIG. 1.

If starting extrusion, the frictional force between the inside walls of the billet 14 and the mandrel 31 will cause a pull force to act on the mandrel 31 in the extrusion direction. There is a loss of extrusion force of exactly the amount of this force. If applying pressurized oil to the rod side 40 of the piercer cylinder 36 which is fastened at the inside of the main ram 24 against this pull force, a force F will act on the piercer cylinder rod 35 in the counter-extrusion direction and, simultaneously, a force F will act on the main cross head 23 as reaction force in the extrusion direction.

This force F acts on the main cross head 23 in the extrusion direction, so the load is propagated to the pressure stem 22 at its front end and the force F is added to this extrusion force whereby the extrusion force is increased.

The method of control of the piercer cylinder which supplements the extrusion force to counter the mandrel pull force explained above will be explained with reference to FIG. 1.

The pull force which acts on the mandrel 31 is propagated as load to the sub mandrel 32, sub mandrel holder 39, and piercer cross head 33, so a tension force acts in the extrusion direction of the mandrel cylinder stop rods 37. This tension force is detected by a load sensor 50, then the obtained signal is amplified by an amplifier 51, then a controller 52 converts the force to pressure and controls the pressure of a proportional solenoid relief 55. The pressurized oil which is sent from a variable discharge type hydraulic pump 56 is sent to the rod side 40 of the piercer cylinder 36 by a pressure value of the pressure setting of the proportional solenoid relief 55 after a solenoid valve 53 is turned ON (in FIG. 1, the ON state shown). For example, the pressure value of the oil is 31 MPa etc. at the time of start of extrusion. Due to this pressurized oil, it is possible to increase the extrusion force.

In summary, the pressure setting valve is changed in setting in accordance with a predetermined hydraulic pressure to set the initial pressure right after extrusion. During extrusion, the mandrel pull force is constantly detected while the pressure is controlled so that the above value becomes close to zero to thereby prevent a drop in the extrusion force acting on the die due to the mandrel pull force and enable a predetermined extrusion force to act on the die at all times.

Next, the position of the front end of the mandrel 31 will be explained.

The front end of the mandrel 31 is positioned through the sub mandrel 32, sub mandrel holder 39, piercer cross head 33, and mandrel stop rods 37 by the mandrel cylinders 38. The mandrel cylinders 38 are fastened to the cylinder platen 15, while the cylinder platen 15 is fastened by not shown tierods to the end platen 11. The die 12 is placed at the end platen 11, so the position of the front end of the mandrel 31 is determined by the mandrel cylinders 38. Furthermore, when the mandrel stop rods 37 are positioned at the advancing limit in the extrusion direction, it matches in position with the bearing part of the die 12.

Furthermore, by adjusting a screw of the mandrel stopper device 42, it is possible to finely adjust the position of the front end of the mandrel 31 to match with the lengths of various mandrels 31.

In the above-mentioned embodiment of the present invention, the configuration of a conventional press of a direct double action extrusion press is explained, but the invention is not limited to this configuration. It may also be configured as a front loading pressure of a direct double action extrusion press or an indirect double action extrusion press.

As explained above, the double action extrusion press of the present invention detects the pull force which acts on the mandrel and supplies pressurized oil, set in pressure so that the extrusion force which has been reduced by that pull force becomes a hydraulic pressure of a predetermined corresponding force, to the rod side of the piercer cylinder by a variable discharge type hydraulic pump to thereby supplement the extrusion force, so it becomes possible to extrude thin tubular shaped products or long size billets which could not be extruded in the past, it becomes possible to reduce the size of a double action extrusion press, and it becomes possible to improve the productivity and achieve energy savings and labor savings. Further, even if the extrusion force fluctuates during the extrusion operation, there is no need to adjust the pressure or amount of feed of the working oil which is supplied to the piercer cylinder each time and therefore the operability can be improved.

Furthermore, there are the effects that it becomes possible to accurately position the front end of the mandrel, there is no longer a need to adjust the working oil or amount of oil each time, and the operability is improved.

Note that, the present invention was explained in detail based on a specific embodiment, but a person skilled in the art could make various changes, corrections, etc. without departing from the claims and concept of the present invention.

REFERENCE SIGNS LIST

11 end platen
12 die
14 billet
15 cylinder platen
22 pressure stem
23 main cross head
24 main ram
26 side cylinder rod
27 side cylinder
31 mandrel
32 sub mandrel
33 piercer cross head
35 piercer cylinder rod
36 piercer cylinder
37 mandrel stop rod
38 mandrel cylinder
50 load sensor
51 amplifier
52 controller
55 proportional solenoid relief
56 variable discharge type hydraulic pump

The invention claimed is:

1. A double action extrusion press system comprising:

a main cross head adapted to be able to be pushed in an axial direction by a main cylinder fastened to a cylinder platen and having a pressure stem at its front end;

a piercer cross head to which a mandrel is fastened;

a piercer cylinder adapted to slide the mandrel in said pressure stem and said main cross head and being provided in a main ram which is built into said main cylinder, the piercer cylinder being fastened to the main cross head;

a plurality of mandrel cylinders fastened to the cylinder platen and having mandrel stop rods fixedly connected to the piercer cross head to drive the mandrel, wherein a piercer cylinder rod of said piercer cylinder is fixedly connected to the piercer cross head, and an extrusion force is supplemented by applying hydraulic pressure to a rod side of the piercer cylinder so as to counter a mandrel pull force which acts on the mandrel stop rods; and a means for detecting the mandrel pull force which acts on the mandrel stop rods and controls the hydraulic pressure at the rod side of said piercer cylinder to become a hydraulic pressure of a predetermined force corresponding to the mandrel pull force which is detected by said means to thereby make up for the part of the extrusion force which is lost as the mandrel pull force.

2. The double action extrusion press system according to claim 1, wherein when the mandrel stop rods of the mandrel cylinders are positioned at an advancing limit in an extrusion direction, a front end part of the mandrel is positioned at a bearing part of a die which determines a size of a tubular shape.

3. The double action extrusion press system according to claim 1, wherein the mandrel cylinders are fastened to the outer circumference of the main cylinder.

4. The double action extrusion press system according to claim 1, wherein the piercer cross head is arranged to move inside the main cross head.

5. The double action extrusion press system according to claim 1, wherein a variable discharge type hydraulic pump is used to enable adjustment of an amount of oil of the piercer cylinder.

* * * * *